US009945262B2

(12) United States Patent
Hanrahan et al.

(10) Patent No.: US 9,945,262 B2
(45) Date of Patent: Apr. 17, 2018

(54) MODULAR COMPONENTS FOR GAS TURBINE ENGINES

(71) Applicant: UNITED TECHNOLOGIES CORPORATION, Farmington, CT (US)

(72) Inventors: Paul R. Hanrahan, Farmington, CT (US); George E. Allen, Manchester, CT (US); Christopher M. Juh, South Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 496 days.

(21) Appl. No.: 14/625,025

(22) Filed: Feb. 18, 2015

(65) Prior Publication Data

US 2016/0237857 A1 Aug. 18, 2016

(51) Int. Cl.
*F01D 25/28* (2006.01)
*F01D 5/02* (2006.01)

(52) U.S. Cl.
CPC ..... *F01D 25/285* (2013.01); *F01D 5/026* (2013.01); *F05D 2230/60* (2013.01); *F05D 2230/70* (2013.01)

(58) Field of Classification Search
CPC .... F01D 5/026; F01D 25/285; F05D 2230/60; F05D 2230/70
See application file for complete search history.

(56) References Cited

U.S. PATENT DOCUMENTS 3,631,688 A * 1/1972 Quick ..... F01D 5/026 403/316
4,836,750 A * 6/1989 Modafferi ..... F01D 5/025 403/28
6,082,959 A * 7/2000 Van Duyn ..... F01D 21/045 415/173.4
2005/0013696 A1* 1/2005 Le Jeune ..... F01D 5/025 416/244 A
2006/0233479 A1* 10/2006 Bouiller ..... F01D 25/16 384/561

(Continued)

FOREIGN PATENT DOCUMENTS

EP 2957720 A1 12/2015

OTHER PUBLICATIONS

U.S. Appl. No. 62/015,010, filed Jun. 20, 2014.
European Search Report for Application No. EP 16 15 6366.

*Primary Examiner* — Igor Kershteyn
(74) *Attorney, Agent, or Firm* — Cantor Colburn LLP

(57) ABSTRACT

A system for maintaining a position of a bearing compartment in a gas turbine during disassembly of a low-pressure turbine of the gas turbine engine includes a forward annular shaft defining an engine centerline axis. The system includes a ring radially inward from and engaged with an inner diameter surface of the forward annular shaft. An aft annular shaft is radially inward from the forward annular shaft and aft of the ring. The ring is connected to a forward end of the aft annular shaft for common rotation therewith. The ring retains the aft annular shaft during disassembly. The system includes a stack nut axially held between an aft facing shoulder of the forward annular stub shaft and a forward facing surface of the ring to retain the stack nut during disassembly.

20 Claims, 6 Drawing Sheets

(56) References Cited

U.S. PATENT DOCUMENTS

| | | | | |
|---|---|---|---|---|
| 2009/0123271 | A1* | 5/2009 | Coffin | F01D 25/16<br>415/142 |
| 2010/0158699 | A1* | 6/2010 | Makuszewski | F01D 5/066<br>416/244 A |
| 2011/0146298 | A1* | 6/2011 | Reinhardt | F01D 5/066<br>60/796 |
| 2011/0223026 | A1* | 9/2011 | Benjamin | F01D 5/066<br>416/198 A |
| 2012/0076657 | A1 | 3/2012 | Ress, Jr. | |
| 2013/0202349 | A1 | 8/2013 | Coffin | |
| 2015/0369123 | A1* | 12/2015 | Hanrahan | F02C 3/107<br>29/888.021 |

* cited by examiner

MODULAR COMPONENTS FOR GAS TURBINE ENGINES

BACKGROUND OF THE INVENTION

1. Field of the Invention

The present disclosure relates to gas turbine engines, and more particularly to modular components in gas turbine engines.

2. Description of Related Art

Gas turbine engines, such as turbo fan engines, turbo shaft engines, or the like, typically include low and high-pressure compressor sections, a combustor section, and low and high-pressure turbine sections. From time to time, these sections need to be assembled and disassembled. If one section needs to be removed, this may result in another section or other engine components also being removed, even if there is no other reason to remove the other section or components. For example, to access a high-pressure turbine section for repair, a low-pressure turbine is also typically removed just to access the high-pressure turbine.

Such conventional methods and systems have generally been considered satisfactory for their intended purpose. However, there is still a need in the art for improved gas turbine engines.

SUMMARY OF THE EMBODIMENTS

A system for maintaining a position of a bearing compartment in a gas turbine during disassembly of a low-pressure turbine of the gas turbine engine includes a forward annular shaft defining an engine centerline axis. The system includes a ring radially inward from and engaged with an inner diameter surface of the forward annular shaft. An aft annular shaft is radially inward from the forward annular shaft and aft of the ring. The ring is connected to a forward end of the aft annular shaft for common rotation therewith. The ring retains the aft annular shaft during disassembly. The system includes a stack nut axially held between an aft facing shoulder of the forward annular stub shaft and a forward facing surface of the ring to retain the stack nut during disassembly.

In accordance with certain embodiments, the forward and aft annular shafts are forward and aft annular stub shafts. The system can include a shaft radially inward from the stack nut and aft annular stub shaft. The shaft can have a threaded outer diameter surface engaged with a corresponding threaded inner diameter surface of the stack nut. The stack nut can include a threaded inner diameter surface. An aft end of the aft annular stub shaft includes a splined inner diameter surface. The shaft can have a splined outer diameter surface engaged with a corresponding splined inner diameter surface of an aft end of the aft annular stub shaft. The stack nut can include a grooved inner diameter surface to engage with a power turbine shaft. The inner diameter surface of the forward annular stub shaft can include an annular notch for receiving the ring. The forward annular shaft can be integrally formed with the rotor disk to form a rotor hub. The ring can be made from a plurality of arcuate ring segments joined together. An aft end of the ring can include a locking feature operatively connected to a corresponding locking feature on a forward end of the aft annular stub shaft to retain the aft annular stub shaft.

A gas turbine engine includes a shaft connecting a compressor section and a turbine section, wherein the shaft defines an engine centerline axis. A forward annular stub shaft is radially outboard from the shaft for keeping a bearing compartment in place during removal of the shaft. The gas turbine engine includes a ring, as described above, and an aft annular stub shaft. The aft annular stub shaft is radially between the forward annular stub shaft and the shaft. The aft annular stub shaft is operatively connected to an outer diameter of the shaft and operatively connected to an aft end of the ring for common rotation with the shaft and the ring. The gas turbine engine includes a stack nut operatively connected to an outer diameter of the shaft. The stack nut is axially held between an aft facing shoulder of the forward annular stub shaft and a forward facing surface of the ring to retain the stack nut during removal of the shaft. A bearing compartment is radially outward from the forward annular stub shaft. The forward annular stub shaft maintains the axial and radial position of the bearing compartment with respect to the engine centerline axis when the shaft is removed.

The gas turbine engine can include a power turbine shaft radially inward from the shaft, wherein the stack nut includes a grooved inner diameter surface and the power turbine shaft includes a corresponding grooved outer diameter surface. The aft annular stub shaft can include an aft facing shoulder surface operatively connected to a forward facing shoulder surface of the shaft to axially position the shaft. The power turbine shaft includes a grooved outer diameter surface to engage with the grooved surface of the stack nut. During disassembly of the shaft from the stack nut, the inner diameter surface of the stack nut and the outer diameter surface of the power turbine shaft can be engaged for rotation to unthread the shaft from the stack nut.

A method for removing portions of a low-pressure turbine section of a gas turbine engine while maintaining the position of a bearing compartment includes rotatably engaging a stack nut with a forward end of a power turbine shaft. The method includes moving a low-pressure turbine shaft from a forward threaded position, where the low-pressure turbine shaft is in threaded engagement with the stack nut and radially inward from the stack nut, to an aft unthreaded position, by rotating the power turbine shaft thereby applying torque to the stack nut and unthreading the low-pressure turbine shaft from the stack nut. The method includes removing the power turbine shaft and removing the low-pressure turbine shaft.

Removing the low-pressure turbine shaft can include removing a low-pressure turbine. The method can include sliding the power turbine shaft in an aft direction to align engaging surfaces of the power turbine shaft and the stack nut. Sliding the power turbine shaft in an aft direction can include uncoupling a forward end of power turbine shaft from a power turbine transmission to facilitate the sliding. The method can include removing a power turbine to expose a low-pressure turbine.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE EMBODIMENTS

Figure 1:
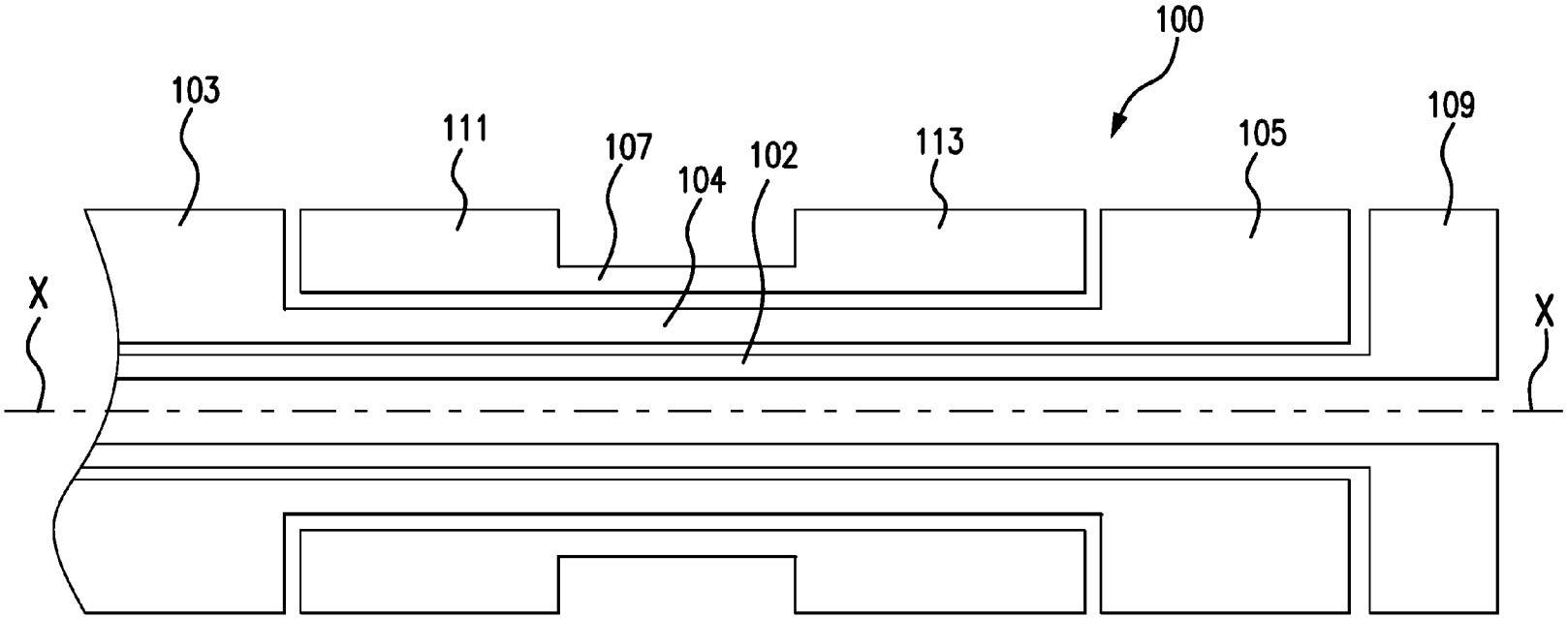
FIG. 1 is a schematic cross-sectional side elevation view of a portion of an exemplary embodiment of a gas turbine engine constructed in accordance with the present disclosure.

Reference will now be made to the drawings wherein like reference numerals identify similar structural features or aspects of the subject disclosure. For purposes of explanation and illustration, and not limitation, a partial view of an exemplary embodiment of a portion of a gas turbine engine constructed in accordance with the disclosure is shown in FIG. 1 and is designated generally by reference character 100. Other embodiments of gas turbine engines in accordance with this disclosure, or aspects thereof, are provided in FIGS. 2-9, as will be described. Embodiments of the invention provide a modular low-pressure compressor assembly that retains a bearing compartment in the low-pressure compressor when the low-pressure turbine shaft is removed, making disassembly of the high-pressure turbine section and low-pressure turbine section easier, less-costly and less invasive.

A shown in FIG. 1, a three-spool turbo shaft engine 100 includes a power turbine shaft 102 defining an engine centerline axis X. Power turbine shaft 102 is operatively connected to a power turbine 109 and is radially inward from a low-pressure turbine shaft 104. Low-pressure turbine shaft 104 operatively connects a low-pressure compressor 103 and a low-pressure turbine 105. A high-pressure turbine shaft 107 is radially outward of low-pressure turbine shaft 104. High-pressure turbine shaft 107 operatively connects a high-pressure compressor 111 and a high-pressure turbine 113. Those skilled in the art will readily appreciate that while described in the context of a three-spool turbo shaft engine, embodiments of the invention can also be used on a high-bypass ratio geared turbofan engine, or any other suitable turbomachine.

Figure 2:
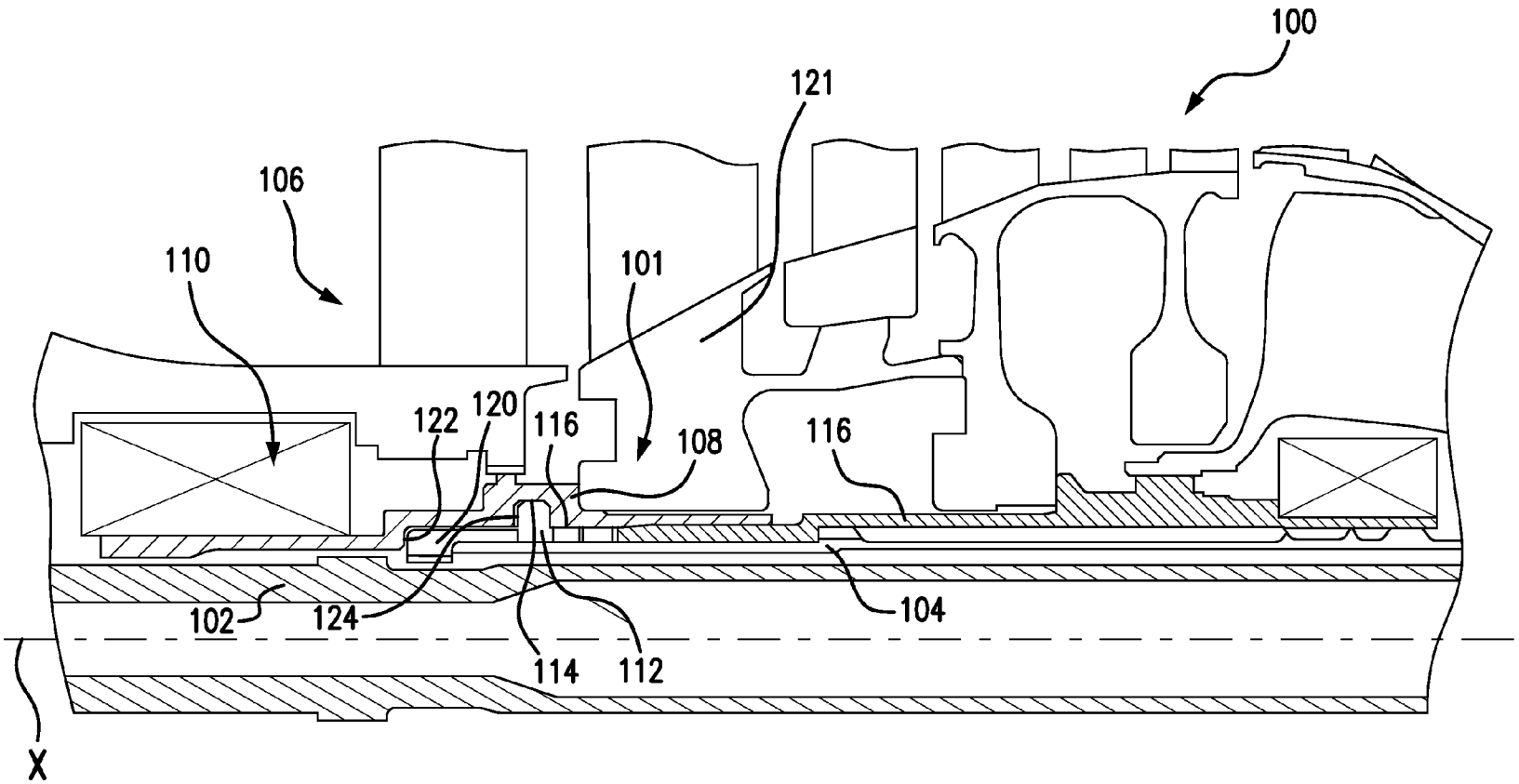
FIG. 2 is a schematic cross-sectional side elevation view of a portion of the gas turbine engine of FIG. 1, showing a modular assembly between a low-pressure turbine shaft and a bearing compartment.

As shown in FIG. 2, engine 100 includes a modular assembly 101 between the low-pressure compressor 103 and low-pressure turbine shaft 104. Modular assembly 101 includes a forward annular stub shaft 108 radially outboard from shaft 104 for keeping a bearing compartment 110 of low-pressure compressor 103 in place during removal of shaft 104. Bearing compartment 110 is radially outward from forward annular stub shaft 108. Modular assembly 101 of engine 100 includes an aft annular stub shaft 116 radially inward from forward annular stub shaft 108, radially between forward annular stub shaft 108 and shaft 104. Modular assembly 101 of engine 100 includes a ring 112 radially inward from and engaged with an inner diameter surface 114 of forward annular stub shaft 108, and a stack nut 120 axially held between forward stub shaft 108 and ring 112 to retain stack nut 120 during disassembly. Those skilled in the art will readily appreciate that "forward" and "aft" are used in relation to FIGS. 1-9, not as a limitation with respect to an airframe or the like. Those skilled in the art will readily appreciate that while forward annular stub shaft 108 is shown separate from a rotor disk 121, it is contemplated that forward annular stub shaft 108 can be integrally formed with rotor disk 121 to form a rotor hub.

Figure 3:
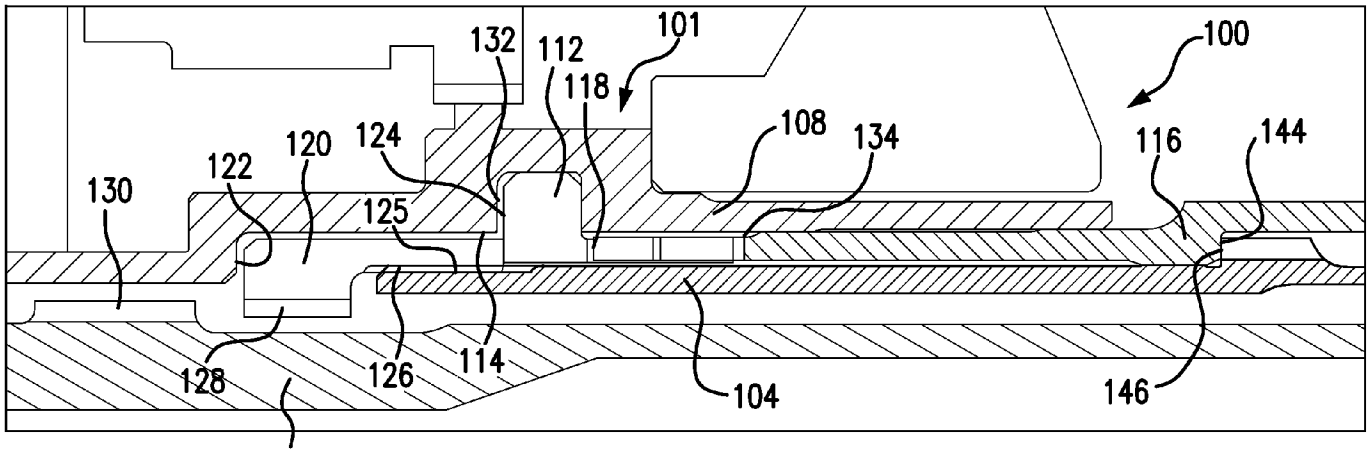
FIG. 3 is a schematic cross-sectional side elevation view of a portion of the gas turbine engine of FIG. 1, showing forward and aft stub shafts, a ring and a stack nut.

As shown in FIG. 3, inner diameter surface 114 of forward annular stub shaft 108 includes an annular notch 132 for receiving ring 112. Stack nut 120 is axially held between an aft facing shoulder 122 of forward annular stub shaft 108 and a forward facing surface 124 of ring 112 as to be retained even when shaft 104 is removed. Stack nut 120 includes a grooved inner diameter surface 128 and power turbine shaft 102 includes a corresponding grooved outer diameter surface 130. Stack nut 120 includes a threaded inner diameter surface 126 that corresponds with a threaded outer diameter surface 125 of shaft 104.

FIG. 3 is showing an assembled position where threaded inner diameter surface 126 of stack nut is engaged with a threaded outer diameter surface 125 of shaft 104, while grooved inner diameter surface 128 of stack nut 120 and grooved outer diameter surface 130 of power turbine shaft 102 are not engaged. During disassembly of shaft 104 from stack nut 120, described in more detail below, grooved inner diameter surface 128 of stack nut 120 and grooved outer diameter surface 130 of power turbine shaft 102 are engaged for common rotation to unthread threaded outer diameter surface 125 of shaft from threaded inner diameter surface 126 of stack nut 120. Stack nut 120 can also provide axial pre-load to low-pressure compressor section 103. During assembly, modular assembly 101 is tightened together for common rotation amongst the portions of the modular assembly 101 by turning stack nut 120 relative to shaft 104 and engaging threaded outer diameter surface 125 of shaft. Stack nut 120 is moved in an aft direction relative to shaft 104, until stack nut 120 pushes up against aft stub shaft 116, which in turn pushes up against shaft 104 through shoulder surfaces 144 and 146, described in more detail below. This simultaneously places shaft 104 in tension and assembly 101 in compression, creating the tightness described above.

Figure 4:
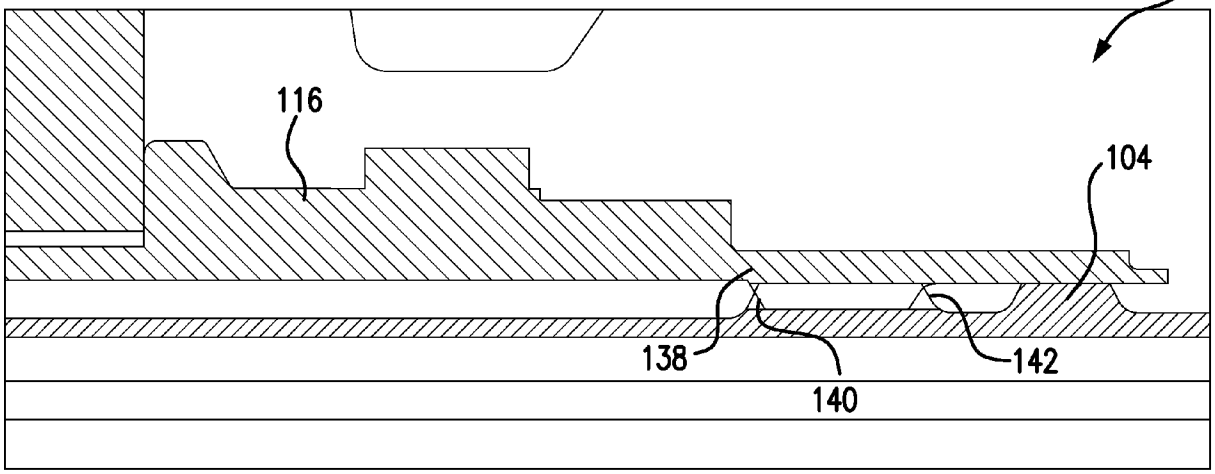
FIG. 4 is a schematic cross-sectional side elevation view of a portion of the gas turbine engine of FIG. 1, showing the engagement between the aft stub shaft and a low-pressure turbine shaft.

Now with reference to FIGS. 3 and 4, aft annular stub shaft 116 is operatively connected to an outer diameter of shaft 104 for common rotation with shaft 104. An aft end 138 of aft stub shaft 116 includes a splined inner diameter surface 140 and shaft 104 includes a corresponding splined outer diameter surface 142 for engagement therewith. Aft annular stub shaft 116 includes an aft facing shoulder surface 144 operatively connected to a forward facing shoulder surface 146 of shaft 104. Shoulder surface 144 acts to pre-load and axially position shaft 104.

Figure 5:
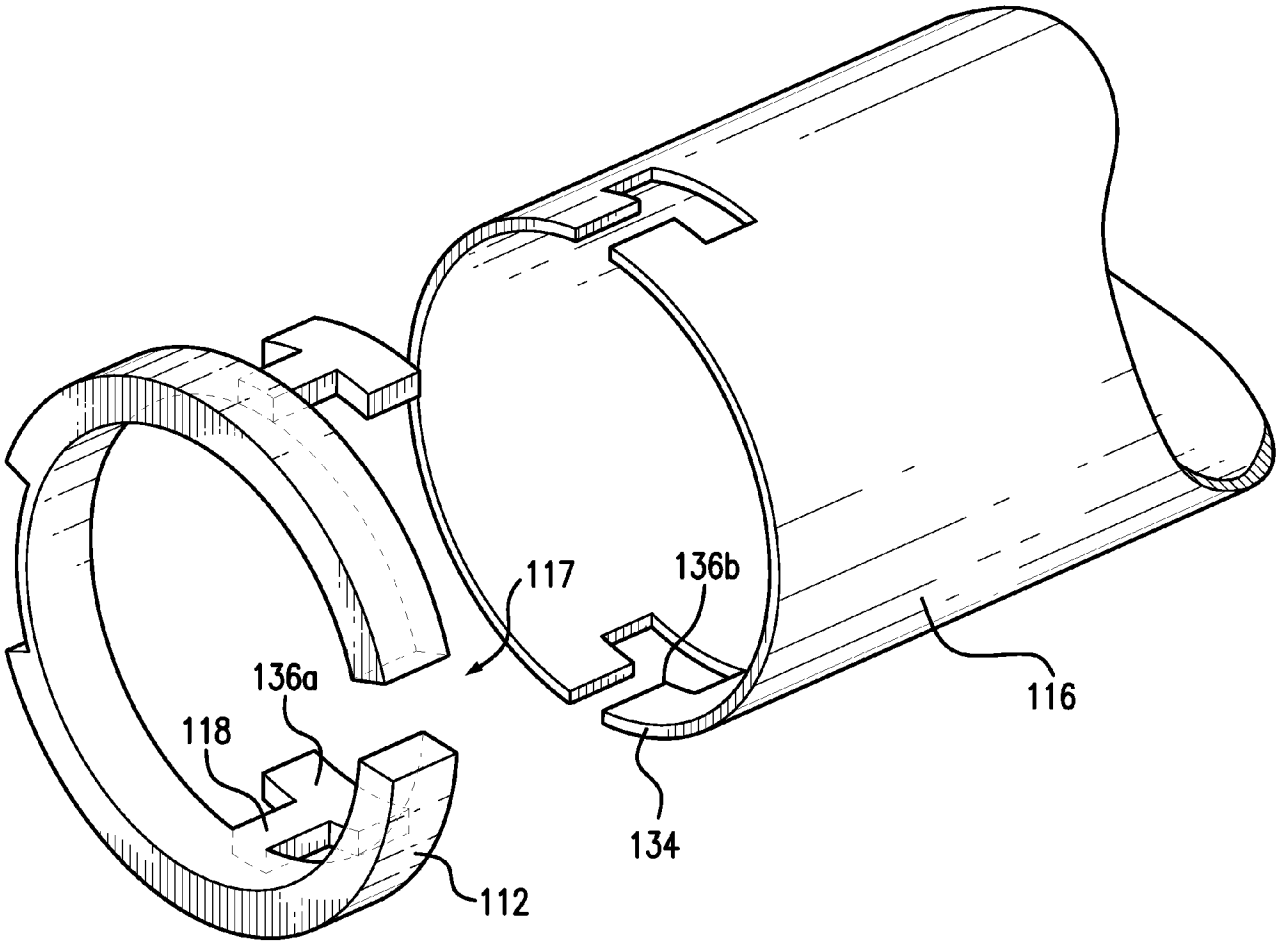
FIG. 5 is a schematic perspective view of a portion of the gas turbine engine of FIG. 1, showing the engagement between a forward side of the aft stub shaft and the ring.

As shown in FIG. 5, ring 112 is a split ring, as shown by split 117, so that during assembly it can be compressed to fit inside of annular notch 132 of forward annular stub shaft 108. Once ring 112 is within notch 132, the compression can be released and ring 112 will expand into notch 132. An aft end 118 of ring 112 includes a locking feature 136*a* operatively connected to a corresponding locking feature 136*b* on a forward end 134 of aft annular stub shaft 116, such as a key and keyway fit. This interlocking retains aft annular stub shaft 116 during disassembly in addition to providing common rotation of aft annular stub shaft 116 and ring 112. While locking features 136*a* and 136*b* are shown in a dove-tail configuration, those skilled in the art will readily appreciate that a variety of suitable locking mechanisms can be used. For example, ring 112 can be made from a plurality of arcuate ring segments joined together to form full hoop.

Figure 6:
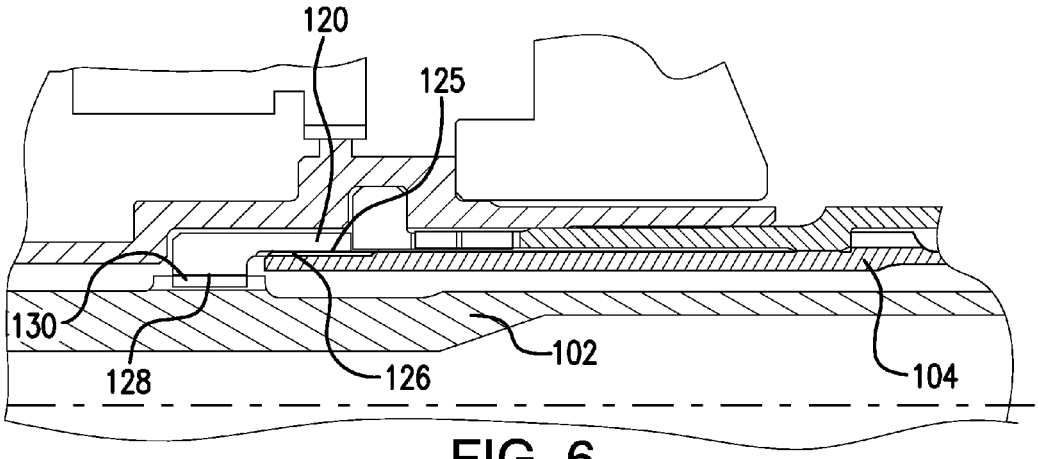
FIG. 6 is a schematic cross-sectional side elevation view of a portion of the gas turbine engine of FIG. 1 during disassembly, showing the engagement between the stack nut and the power turbine shaft.
Figure 7:
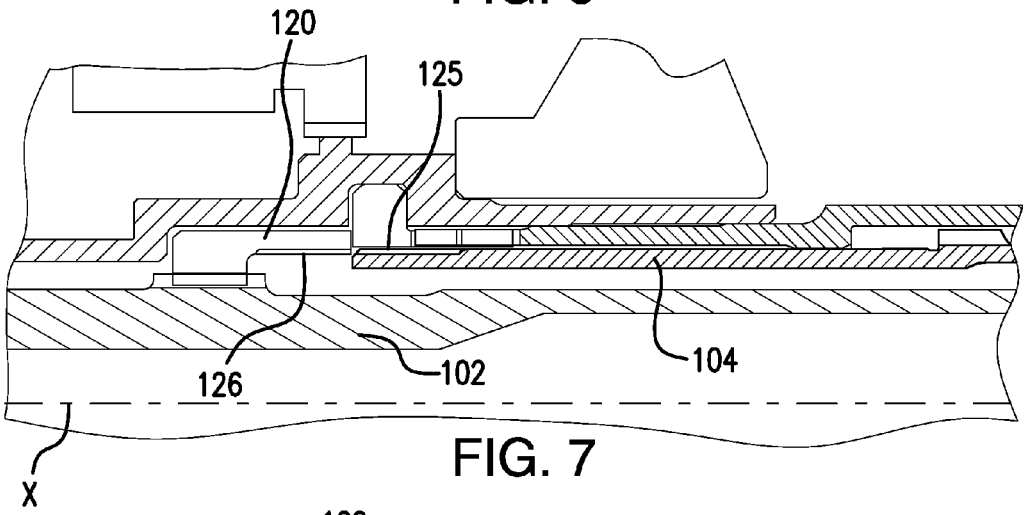
FIG. 7 is a schematic cross-sectional side elevation view of a portion of the gas turbine engine of FIG. 1 during disassembly, showing the low-pressure turbine shaft disengaged from the stack nut.
Figure 8:
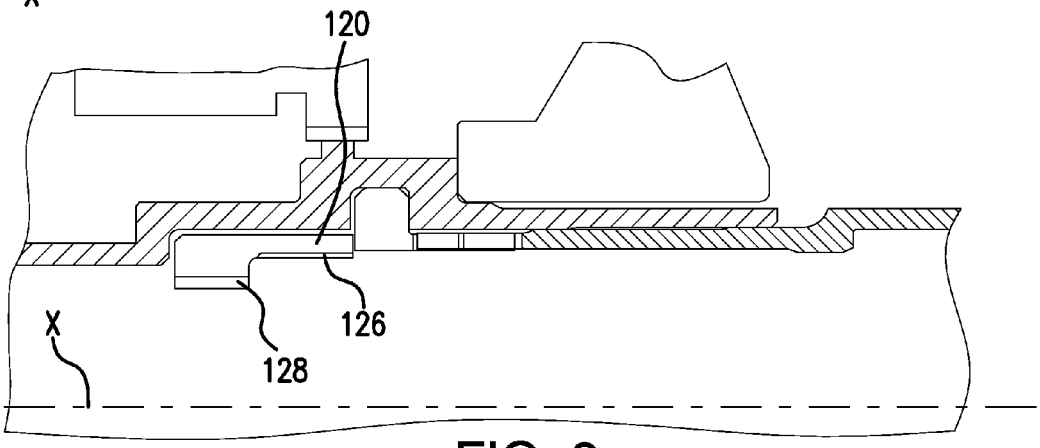
FIG. 8 is a schematic cross-sectional side elevation view of a portion of the gas turbine engine of FIG. 1 during disassembly, showing the low-pressure turbine shaft and power turbine shaft removed while forward and aft stub shafts, stack nut, and ring are still assembled.
Figure 9:
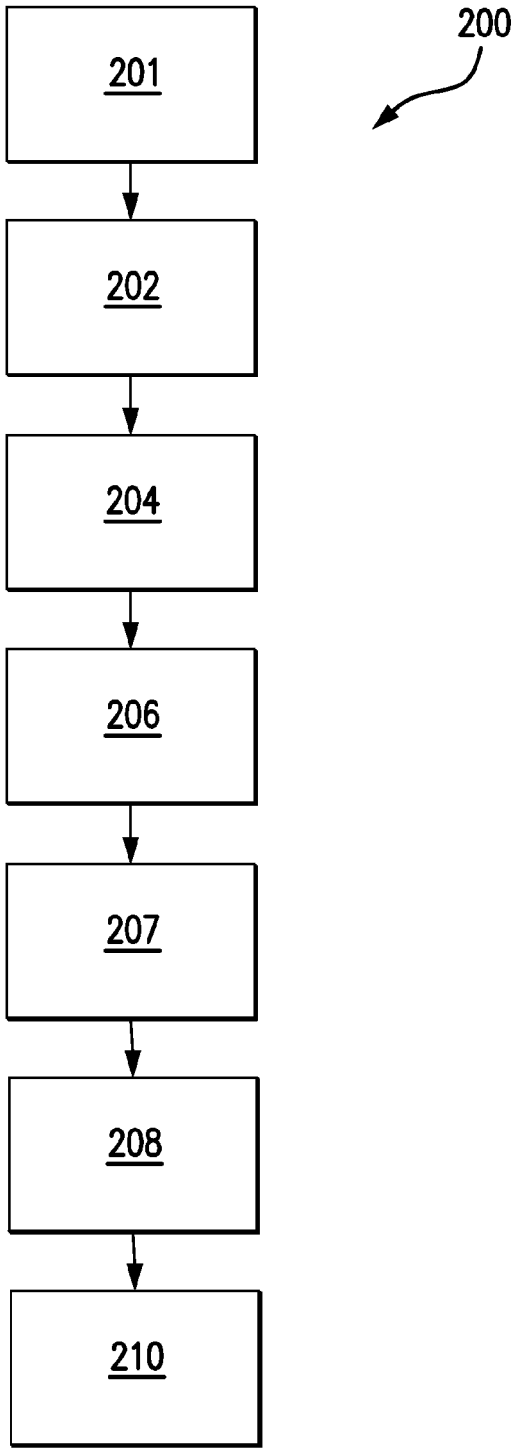
FIG. 9 is a schematic diagram of a method of removing portions of the gas turbine engine of FIG. 1, showing the steps of disassembly.

Now with reference to FIGS. 6-8, during disassembly of shaft 104 from stack nut 120, inner diameter surface 128 of stack nut 120 and outer diameter surface 130 of power turbine shaft 102 are engaged with one another, for common rotation, to unthread shaft 104 from threaded inner diameter surface 126 of stack nut 120. When engaged, rotation of power turbine shaft 102, torques stack nut 120, driving shaft 104 in an aft direction to an unthreaded position, shown in FIG. 6. Once moved into an unthreaded position, shaft 104, as shown in FIG. 7, is free to be removed.

With continued reference to FIGS. 6-9, a method 200 for removing portions of a low-pressure turbine section of a gas turbine engine is shown. Method 200 includes uncoupling a forward end of a power turbine shaft, e.g. power turbine shaft 102, from a power turbine transmission, as indicated schematically by box 201. Method 200 includes sliding the power turbine shaft, in an aft direction to align engaging surfaces, e.g. surfaces 130 and 128, of the power turbine shaft and a stack nut, e.g. stack nut 120, as indicated schematically by box 202. Method 200 includes rotatably engaging the stack nut with a forward end of the power turbine shaft, as shown in FIG. 6 and as schematically shown by box 204. Method 200 includes moving a low-pressure turbine shaft, e.g. shaft 104, from a forward threaded position, where the low-pressure turbine shaft is in threaded engagement with the stack nut, to an aft unthreaded position, as shown in FIG. 7 and as schematically shown by box 206, by rotating the power turbine shaft, thereby applying torque to the stack nut and unthreading the low-pressure turbine shaft from the stack nut. Moving the low-pressure turbine shaft from a forward threaded position to an aft unthreaded position includes removing a low-pressure turbine, e.g. low pressure turbine 113, as indicated schematically by box 207. Method 200 includes removing the power turbine shaft and/or removing the low-pressure turbine shaft, as indicated schematically by box 208. Method 200 includes removing a power turbine to expose a low-pressure turbine, as indicated schematically by box 210.

The methods and systems of the present disclosure, as described above and shown in the drawings, provide for gas turbine engines with reduced disassembly time and reduced maintenance costs. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A system for maintaining a position of a bearing compartment in a gas turbine during disassembly of a low-pressure turbine of the gas turbine engine comprising:

a forward annular shaft defining an engine centerline axis;

a ring radially inward from and engaged with an inner diameter surface of the forward annular shaft;

an aft annular shaft radially inward from the forward annular shaft and aft of the ring, wherein the ring is connected to a forward end of the aft annular shaft for common rotation therewith, the ring retaining the aft annular shaft during disassembly; and a stack nut axially held between an aft facing shoulder of the forward annular shaft and a forward facing surface of the ring to retain the stack nut during disassembly.

2. A system as recited in claim 1, further comprising a shaft radially inward from the stack nut and aft annular shaft, wherein the aft annular shaft is an aft annular stub shaft, the shaft having a threaded outer diameter surface engaged with a corresponding threaded inner diameter surface of the stack nut.

3. A system as recited in claim 1, further comprising a shaft radially inward from the stack nut and aft annular shaft, wherein the aft annular shaft is an aft annular stub shaft, the shaft having a splined outer diameter surface engaged with a corresponding splined inner diameter surface of an aft end of the aft annular stub shaft.

4. A system as recited in claim 1, wherein the stack nut includes a threaded inner diameter surface.

5. A system as recited in claim 1, wherein the aft annular shaft is an aft annular stub shaft, and wherein an aft end of the aft annular stub shaft includes a splined inner diameter surface.

6. A system as recited in claim 1, wherein the stack nut includes a grooved inner diameter surface to engage with a power turbine shaft.

7. A system as recited in claim 1, wherein the forward annular shaft is a forward annular stub shaft, wherein an inner diameter surface of the forward annular stub shaft includes an annular notch for receiving the ring.

8. A system as recited in claim 1, wherein the forward annular shaft is integrally formed with a rotor disk to form a rotor hub.

9. A system as recited in claim 1, wherein the aft annular shaft is an aft annular stub shaft, wherein an aft end of the ring includes a locking feature operatively connected to a corresponding locking feature on a forward end of the aft annular stub shaft to retain the aft annular stub shaft.

10. A gas turbine engine comprising:

a shaft connecting a compressor section and a turbine section, wherein the shaft defines an engine centerline axis;

a forward annular stub shaft radially outboard from the shaft for keeping a bearing compartment in place during removal of the shaft;

a ring radially inward from and engaged with an inner diameter surface of the forward annular stub shaft;

an aft annular stub shaft radially between the forward annular stub shaft and the shaft, wherein the aft annular stub shaft is operatively connected to an outer diameter of the shaft and operatively connected to an aft end of the ring for common rotation with the shaft and the ring;

a stack nut operatively connected to an outer diameter of the shaft, wherein the stack nut is axially held between an aft facing shoulder of the forward annular stub shaft and a forward facing surface of the ring to retain the stack nut during removal of the shaft; and a bearing compartment radially outward from the forward annular stub shaft, wherein the forward annular stub shaft maintains the axial and radial position of the bearing compartment with respect to the engine centerline axis when the shaft is removed.

11. A gas turbine engine as recited in claim 10, further comprising a power turbine shaft radially inward from the shaft, wherein the stack nut includes a grooved inner diameter surface and the power turbine shaft includes a corresponding grooved outer diameter surface.

12. A gas turbine engine as recited in claim 10, wherein the stack nut includes a threaded inner diameter surface operatively connected to a threaded outer diameter surface of the shaft.

13. A gas turbine engine as recited in claim 10, wherein the shaft has a splined outer diameter surface engaged with a corresponding splined inner diameter surface of an aft end of the aft stub shaft.

14. A gas turbine engine as recited in claim 10, wherein the aft annular stub shaft includes an aft facing shoulder surface operatively connected to a forward facing shoulder surface of the shaft to axially position the shaft.

15. A gas turbine engine as recited in claim 11, wherein the stack nut includes a grooved inner diameter surface and the power turbine shaft includes a corresponding grooved outer diameter surface, and wherein the stack nut includes a threaded inner diameter surface operatively connected to a threaded outer diameter surface of the shaft, wherein during disassembly of the shaft from the stack nut, the inner diameter surface of the stack nut and the outer diameter surface of the power turbine shaft are engaged for rotation to unthread the shaft from the stack nut.

16. A method for removing portions of a low-pressure turbine section of a gas turbine engine while maintaining the position of a bearing compartment, the method comprising:

rotatably engaging a stack nut with a forward end of a power turbine shaft, wherein the power turbine shaft defines an engine centerline axis and wherein the stack nut is radially outboard of the power turbine shaft;

moving a low-pressure turbine shaft from a forward threaded position, wherein the low-pressure turbine shaft is in threaded engagement with the stack nut and radially inward from the stack nut, to an aft unthreaded position by rotating the power turbine shaft thereby applying torque to the stack nut and unthreading the low-pressure turbine shaft from the stack nut;

removing the power turbine shaft; and removing the low-pressure turbine shaft.

17. A method as recited in claim 16, wherein removing the low-pressure turbine shaft includes removing a low-pressure turbine.

18. A method as recited in claim 16, further comprising sliding the power turbine shaft in an aft direction to align engaging surfaces of the power turbine shaft and the stack nut.

19. A method as recited in claim 18, wherein sliding the power turbine shaft in an aft direction includes uncoupling a forward end of power turbine shaft from a power turbine transmission to facilitate the sliding.

20. A method as recited in claim 16, further comprising removing a power turbine to expose a low-pressure turbine without having to remove a bearing compartment.

* * * * *